US006346774B1

(12) United States Patent
Tamai et al.

(10) Patent No.: US 6,346,774 B1
(45) Date of Patent: Feb. 12, 2002

(54) METHOD OF DRIVING PASSIVE MATRIX LIQUID CRYSTAL DISPLAY

(75) Inventors: Kiyoshi Tamai; Makoto Nagai; Akira Nakazawa; Masakazu Kitamura; Yoshinori Hirai, all of Yokohama (JP)

(73) Assignee: Optrex Corporation, Tokyo (JP)

( * ) Notice: Subject to any disclaimer, the term of this patent is extended or adjusted under 35 U.S.C. 154(b) by 0 days.

(21) Appl. No.: 09/509,813

(22) PCT Filed: Oct. 8, 1998

(86) PCT No.: PCT/JP98/04550

§ 371 Date: May 16, 2000

§ 102(e) Date: May 16, 2000

(87) PCT Pub. No.: WO99/19764

PCT Pub. Date: Apr. 22, 1999

(30) Foreign Application Priority Data

Oct. 9, 1997 (JP) ..... 9-277650

(51) Int. Cl.[7] ..... G09G 3/28

(52) U.S. Cl. ..... 315/169.1; 315/169.3; 345/76; 345/208

(58) Field of Search ..... 315/160, 169.1, 315/169.3, 169.2; 345/76, 208, 55, 210, 209

(56) References Cited

U.S. PATENT DOCUMENTS 5,963,184 A * 10/1999 Tokunaga et al. ..... 345/60

FOREIGN PATENT DOCUMENTS

JP 07-049668 A * 2/1995

* cited by examiner

*Primary Examiner*—David Vu
(74) *Attorney, Agent, or Firm*—Oblon, Spivak, McClelland Maier & Neustadt, P.C.

(57) ABSTRACT

Driving is effected by MLA under a condition of $L \neq \sqrt{M}$ or $\sqrt{(M/L \cdot (L+D))} \neq N$ where M represents the total number of row electrodes, L represents the number of simultaneously selected row electrodes, D represents the number of dummy row electrodes and N represents the maximum magnifying power of a column voltage wherein driving is performed at a driving bias ratio which is deviated toward the minimum bias ratio with respect to the optimum bias ratio.

14 Claims, 9 Drawing Sheets

FIG. 4

(a)

$$\begin{array}{r} \text{Row1}\rightarrow \\ \text{Row2}\rightarrow \\ \text{Row3}\rightarrow \\ \text{Row4}\rightarrow \\ \text{Row5}\rightarrow \\ \text{Row6}\rightarrow \end{array} \begin{pmatrix} 1 & 1 & 1 & 1 & 1 & 1 & 1 & 1 \\ 1 & -1 & 1 & -1 & 1 & -1 & 1 & -1 \\ 1 & 1 & -1 & -1 & 1 & 1 & -1 & -1 \\ 1 & -1 & -1 & 1 & 1 & -1 & -1 & 1 \\ 1 & 1 & 1 & 1 & -1 & -1 & -1 & -1 \\ 1 & -1 & 1 & -1 & -1 & 1 & -1 & 1 \end{pmatrix}^t \begin{pmatrix} -1 \\ -1 \\ -1 \\ -1 \\ -1 \\ -1 \end{pmatrix} = (-6,0,-2,0,-2,0,2,0)$$

(b)

$$\begin{array}{r} \text{Row1}\rightarrow \\ \text{Row2}\rightarrow \\ \text{Row3}\rightarrow \\ \text{Row4}\rightarrow \\ \text{Row5}\rightarrow \\ \text{Row6}\rightarrow \\ \\ \\ \end{array} \begin{pmatrix} 1 & 1 & 1 & 1 & 1 & 1 & 1 & 1 \\ 1 & -1 & 1 & -1 & 1 & -1 & 1 & -1 \\ 1 & 1 & -1 & -1 & 1 & 1 & -1 & -1 \\ 1 & -1 & -1 & 1 & 1 & -1 & -1 & 1 \\ 1 & 1 & 1 & 1 & -1 & -1 & -1 & -1 \\ 1 & -1 & 1 & -1 & -1 & 1 & -1 & 1 \\ 1 & 1 & -1 & -1 & -1 & -1 & 1 & 1 \\ 1 & -1 & -1 & 1 & -1 & 1 & 1 & -1 \end{pmatrix}^t \begin{pmatrix} -1 \\ -1 \\ -1 \\ -1 \\ -1 \\ -1 \\ 1 \\ 1 \end{pmatrix} = (-4,0,-4,0,-4,0,4,0)$$

Actual display data

Dummy data 8 row·8 column Hadamard's matrix

Dummy rows

FIG. 6

| M | L | D | N | Minimum driving voltage ($V_{on}/V_{off}$ ① $\geqq 1.13$) | $V_{on}/V_{off}$ ① | VR/VC ① $= B_x$ | Optimum bias ratio $= B_{OPT}$ | 0.3 × Optimum bias ratio | 0.9 × Optimum bias ratio |
|---|---|---|---|---|---|---|---|---|---|
| 32 | 4 | 0 | 4 | 3.63 V | 1.183 | 1.00 | 1.44 | 0.62 | 1.30 |
| 33 | 3 | 1 | 2 | 3.41 V | 1.130 | 1.69 | 3.31 | 0.99 | 2.98 |
| 35 | 5 | 1 | 4 | 3.13 V | 1.149 | 1.00 | 1.63 | 0.49 | 1.47 |
| 32 | 4 | 2 | 4 | 3.59 V | 1.130 | 1.14 | 1.71 | 0.51 | 1.54 |
| 36 | 6 | 2 | 4 | 2.77 V | 1.134 | 1.00 | 1.73 | 0.52 | 1.56 |
| 35 | 5 | 3 | 4 | 3.24 V | 1.130 | 1.20 | 1.86 | 0.56 | 1.67 |
| 32 | 1 | 0 | 1 | 3.43 V | 1.130 | | | | |
| 36 | 6 | 0 | 6 | 3.85 V | 1.183 | 1.00 | 1.00 | 0.30 | 0.90 |

@Vrms = 1.20 V

① Minimum driving voltage at $V_{on}/V_{off} \geqq 1.13$

F I G. 7

| M | L | D | N | Minimum driving voltage ($V_{on}/V_{off} \geqq 1.13$) | $V_{on}/V_{off}$① | IAPT driving voltage ② | Reduction rate of driving voltage (Comparing driving by IAPT) |
|---|---|---|---|---|---|---|---|
| 32 | 4 | 0 | 4 | 3.63 V | 1.183 | 4.54 V | 20.0% |
| 33 | 3 | 1 | 2 | 3.41 V | 1.130 | 3.43 V | 0.6% |
| 35 | 5 | 1 | 4 | 3.13 V | 1.149 | 3.77 V | 17.0% |
| 32 | 4 | 2 | 4 | 3.24 V | 1.130 | 3.43 V | 5.5% |
| 36 | 6 | 2 | 4 | 2.77 V | 1.134 | 3.50 V | 20.9% |
| 35 | 5 | 3 | 4 | 3.24 V | 1.130 | 3.43 V | 5.5% |

@Vrms = 1.20 V

① Minimum driving voltage at $V_{on}/V_{off} \geqq 1.13$

② Vd becomes minimum at $V_{on}/V_{off} \geqq 1.13$ in MLA driving method

Driving voltage of $V_{on}/V_{off}$ in IAPT driving method (M=32)

F I G. 8

| M | L | D | N | Minimum driving voltage ($V_{on}/V_{off} \geqq 1.08$) | $V_{on}/V_{off}$③ | VR/VC③ = $B_x$ | Optimum bias ratio = $B_{OPT}$ | 0.3 × Optimum bias ratio | 0.9 × Optimum bias ratio |
|---|---|---|---|---|---|---|---|---|---|
| 64 | 4 | 0 | 4 | 5.29 V | 1.106 | 1.00 | 2.00 | 0.60 | 1.80 |
| 65 | 5 | 1 | 4 | 4.43 V | 1.089 | 1.00 | 2.19 | 0.66 | 1.97 |
| 66 | 6 | 1 | 5 | 4.86 V | 1.103 | 1.00 | 1.75 | 0.53 | 1.58 |
| 70 | 7 | 1 | 6 | 5.20 V | 1.109 | 1.00 | 1.50 | 0.45 | 1.35 |
| 64 | 4 | 2 | 4 | 5.00 V | 1.080 | 1.13 | 2.44 | 0.73 | 2.20 |
| 65 | 5 | 2 | 5 | 4.98 V | 1.090 | 1.00 | 1.90 | 0.57 | 1.71 |
| 66 | 6 | 2 | 4 | 3.89 V | 1.080 | 1.00 | 2.38 | 0.71 | 2.14 |
| 65 | 5 | 3 | 4 | 4.74 V | 1.080 | 1.25 | 2.56 | 0.77 | 2.30 |
| 64 | 1 | 0 | 1 | 5.30 V | 1.080 | | | | |
| 64 | 8 | 0 | 8 | 5.84 V | 1.134 | 1.00 | 1.00 | 0.30 | 0.90 |

@Vrms = 1.55 V

① Minimum driving voltage at $V_{on}/V_{off} \geqq 1.08$

FIG. 9

| M | L | D | N | Minimum driving voltage ($V_{on}/V_{off} \geqq 1.08$) | $V_{on}/V_{off}$③ | IAPT driving voltage ④ | Reduction rate of driving voltage (Comparing driving by IAPT) |
|---|---|---|---|---|---|---|---|
| 64 | 4 | 0 | 4 | 5.29 V | 1.106 | 6.65 V | 20.5% |
| 65 | 5 | 1 | 4 | 4.43 V | 1.089 | 5.76 V | 23.1% |
| 66 | 6 | 1 | 5 | 4.86 V | 1.103 | 6.48 V | 25.0% |
| 70 | 7 | 1 | 6 | 5.20 V | 1.109 | 6.81 V | 23.6% |
| 64 | 4 | 2 | 4 | 5.00 V | 1.080 | 5.31 V | 5.8% |
| 65 | 5 | 2 | 5 | 4.98 V | 1.090 | 5.80 V | 14.1% |
| 66 | 6 | 2 | 4 | 3.89 V | 1.080 | 5.31 V | 26.7% |
| 65 | 5 | 3 | 4 | 4.74 V | 1.080 | 5.31 V | 10.7% |

@Vrms = 1.55 V

① Minimum driving voltage at $V_{on}/V_{off} \geqq 1.08$

② Vd becomes minimum at $V_{on}/V_{off} \geqq 1.08$ in MLA driving method

Driving voltage of $V_{on}/V_{off}$ in IAPT driving method (M=64)

METHOD OF DRIVING PASSIVE MATRIX LIQUID CRYSTAL DISPLAY

BACKGROUND OF THE INVENTION

1. Field of the Invention

The present invention relates to a method for driving a simple matrix liquid crystal display device comprising a plurality of liquid crystal elements each being provided in correspondence with each pixel and a plurality of row electrodes and column electrodes for driving the liquid crystal elements by a super-twisted nematic system (hereinbelow, referred to as a STN system) wherein predetermined voltages are applied to the electrodes to control each liquid crystal element so as to produce brightness in response to an effective value of applied voltage whereby a predetermined picture image is displayed on a display area which is comprised of a matrix of the liquid crystal elements. In particular, the present invention relates to a method for driving a simple matrix liquid crystal display device which is capable of reducing voltage for driving the display device.

2. Discussion of the Background

Conventionally, as methods for driving a simple matrix liquid crystal display device provided with electrodes used commonly for a plurality of liquid crystal elements, there are a driving system based mainly on a so-called line successive driving system and a driving system based mainly on a multiple line addressing driving system (or it is called a MLA system).

The line successive driving system is a driving system in which predetermined voltages are successively applied to electrodes of every row, and at the same time, predetermined voltages are applied to a plurality of column electrodes whereby control voltages are applied to the row electrodes. Then, each of the liquid crystal elements is controlled to have a transmittance in response to an average effective voltage applied during a time in which the voltages are once applied to all the row electrodes (hereinbelow, referred to as a frame). A predetermined picture image is displayed for each frame period.

The MLA driving system is a driving system in which all the row electrodes constituting a display picture area are divided into subgroups each comprising a plurality of row electrodes (a simultaneously selected number), and predetermined voltages are applied to row electrodes for each subgroup and at the same time, predetermined voltages are applied to a plurality of column electrodes wherein the above-mentioned operation is repeated at least the same number of times as the simultaneously selected number to all the subgroups. Thus, each of the liquid crystal elements is controlled to have a transmittance in response to an average effective voltage applied during a time in which the above repetitive operations are finished (it is called a frame period), and a displayed picture image is formed in each frame period. Such MLA system is disclosed in Japanese Unexamined Patent Publication JP-A-6-27907, U.S. Pat. No. 5,262,881 and Japanese Unexamined Patent Publication JP-A-8-234164 and so on.

In the MLA driving system, when predetermined voltages are simultaneously applied to a plurality of row electrodes, the voltages applied to the column electrodes are the product of a unit column voltage and values obtained by performing calculation of a plurality of display data at the intersections of column electrodes and row electrodes and column data of orthogonal matrix used for applying the scanning voltages. The maximum value of magnifying power obtained by the matrix calculation suffers restriction by an orthogonal matrix used for the calculation, and it takes at most a value of the number of rows in the matrix.

The liquid crystal display device has been used as a display device for a man-machine interface with the progress of highly intelligent society. In recent years, it is widely used not only for a desktop type personal computer but also for a notebook type personal computer, PDA (a portable information terminal) or a portable telephone, which is suitable for carrying, taking an advantage of thin and light in weight. As a result, the development of the liquid crystal display device tends to increase the surface area of the screen as well as improvements in reduction of the weight and low power consumption.

In such liquid crystal display device, various measures have been taken to lower the power consumption rate. In more detail, there are measures to form a liquid crystal element capable of responding to a low effective voltage or to use a reflection type liquid crystal element without requiring a back light. Further, there is published "General-purpose addressing technology for an effective value response type liquid crystal display device (SID, a record of a meeting of SID international display research society 1988, p. 80–p. 85)" as papers for reporting the relation between a driving method for such liquid crystal display device and electric power consumption. The papers report that when a multiple line driving is performed under conditions that $L=\sqrt{M}$ (where M represents the total number of row electrodes for a display area and L represents a simultaneously selected member) and the optimum bias ratio at which a ratio of an effective voltage versus a ratio between an effective voltage in an ON display time and an effective voltage in an OFF display time becomes the maximum is used, a driving voltage for the liquid crystal display device can be reduced in comparison with a case of using the line successive driving system.

The conventional liquid crystal display device uses a lithium ion battery (a button battery) of relatively high voltage (about 3.3 V) and reduced weight. However, the display device requires a driving voltage of 7–9 V even though an improvement of a liquid crystal material has been made, and accordingly, there is a voltage increase of about 3 times. As a result, there caused power loss due to a voltage increase circuit, which was against an attempt to lower consumption power. Thus, it was impossible to achieve the purpose of lowering consumption power to an extent of a sufficient utility. Further, since such voltage increase circuit required a fairly high breakdown strength, a generally utilized 5 V standard logic process device, which has generally been used, could not be used to increase a degree of integration. Accordingly, a logic process for inclusive use had to be developed to increase a degree of integration. As a result, there is resulted an increase of cost for the liquid crystal display device including a driving device and a prolonged term in designing. Further, there were problems of causing an additional cost in changing designing and difficulty in responding a demand of multi-item-small-production.

In forming actually the voltage increase circuit, there is a problem that the effective voltage changes due to the temperature dependence of liquid crystal whereby it is impossible to apply predetermined column voltages and row voltages. Accordingly, it is necessary to determine a voltage increase level in consideration of a temperature for the liquid crystal. However, working voltages to the liquid crystal itself are apt to vary under the above-mentioned condition. Accordingly, it was necessary to determine a voltage increase level with a larger margin so as to assure operating performance in a low temperature region. This created a cause of an increased power consumption rate by the provision of the voltage increase circuit as an addition circuit.

Further, besides the temperature dependence of the driving voltage, the response speed of liquid crystal becomes high in a high temperature region in a liquid crystal display for providing display data of static images, and there causes reduction of the contrast due to the frame response inherent to the passive matrix, whereby a phenomenon which deteriorates visibility takes place. Recently, there is a demand for a small or middle type liquid crystal devices having the performance capable of sequentially displaying cuts of images or scrolling of images of letters regardless of a high temperature region, which inevitably reduces visibility even in a static image with the tendency that liquid crystal material becomes quickly responsive. In order to respond such demands, it is necessary to increase a driving frequency for the liquid crystal device to thereby prevent a reduction of contrast ratio resulted from the frame response. However the power consumption rate of the liquid crystal display device tends to increase with an increase of the driving frequency. Such poor operational environments create a factor that the device does not have a sufficient utility.

SUMMARY OF THE INVENTION

As a result of extensive study to eliminate the above-mentioned problems, the inventors of the present invention have found that when a MLA driving is used against the reduction of visibility and the MLA driving is performed under a condition of $L \neq \sqrt{M}$, a voltage difference is produced between the maximum column voltage and row voltage at the optimum bias ratio at which an effective voltage ratio in an ON display time and an OFF display time becomes the maximum, and that in a graph having an abscissa which represents the ratio of an effective voltage in an ON display time to an effective voltage in an OFF display time and an ordinate which represents a driving voltage necessary to drive the liquid crystal elements, when one of the maximum column voltage and the scanning voltage is increased, the other is decreased wherein the maximum column voltage coincides with the scanning voltage at a bias ratio other than the maximum bias ratio, and at which point, the driving voltage becomes the minimum and there exists the minimum bias ratio which is lower than the driving voltage at the time of the optimum bias, and thus, the present invention has been accomplished.

It is an object of the present invention to provide a method for driving a simple matrix liquid crystal display device, which can reduce a power consumption rate in comparison with a driving method using the conventional MLA driving system while the ratio of an effective voltage in an ON display time to an effective voltage in an OFF display time can be assured.

Further, it is an object of the present invention to provide a method for driving a simple matrix liquid crystal display device, which can be driven practically by using a battery such as a button battery and which can increase a degree of integration for a driving circuit for the liquid crystal display device by using a standard logic process device.

In accordance with the first aspect of the present invention, a multiple line addressing driving is effected with an L number of simultaneously selected row electrodes to provide $L \neq \sqrt{M}$ where M represents the total number of row electrodes for driving a display area and L represents the number of simultaneously selected row electrodes, wherein driving is performed at a bias ratio which is deviated toward the minimum bias ratio at which a driving voltage is the minimum with respect to the optimum bias ratio $B_{OPT}$ at which a ratio of an effective voltage value in an ON display time to an effective voltage value in an OFF display time is the maximum.

According to the second aspect of the present invention, in the above-mentioned first aspect, the display area is divided into subgroups each comprising L lines; column elements selected in an orthogonal matrix of L lines composed of +1 and −1 are made corresponding to each line of the subgroups; row voltage levels where +1 corresponds to +VR and −1 corresponds to −VR are applied to each row electrode of the subgroups; inner products are obtained from an L number of column data elements, having a value −1 in an ON display time or +1 in an OFF time, which intersect a certain row electrode and column elements in the orthogonal matrix of L lines; predetermined column voltages in proportion to the inner products are applied to the column electrodes in synchronism with the row electrodes, and a bias ratio $B_X$ given by VR/VC where VC represents the maximum column voltage satisfies $1 \leqq B_X < B_{OPT}$.

According to the third aspect of the present invention, in the first or second aspect, $0.3\sqrt{M} \leqq L \leqq 2\sqrt{M}$ and $0.3B_{OPT} \leqq B_X \leqq 0.9B_{OPT}$ are satisfied.

According to the fourth aspect of the present invention, in the first or second aspect, $40 \leqq M \leqq 100$ and $B_X \leqq 0.7B_{OPT}$ are satisfied.

According to the fifth aspect of the present invention, in the first or second aspect, $B_X=1$ is satisfied.

According to the sixth aspect of the present invention, in the first, second, third, fourth or fifth aspect, M=20–40 and L=4 are satisfied.

In accordance with the seventh aspect of the present invention, a multiple line addressing driving is effected with an L number of simultaneously selected row electrodes to provide $\sqrt{(M/L\cdot(L+D))} \neq N$ where M represents the total number of row electrodes for driving a display area, L represents the number of simultaneously selected row electrodes, D represents the number of dummy row electrodes and N represents the maximum magnifying power of a unit column voltage obtained by a predetermined matrix calculation based on display data and scanning voltages applied to the row electrodes, wherein driving is performed at a driving bias ratio which is deviated toward the minimum bias ratio at which a driving voltage is the minimum with respect to the optimum bias ratio $B_{OPT}$ at which a ratio of an effective voltage value in an ON display time to an effective voltage value in an OFF display time is the maximum.

According to the eighth aspect of the present invention, in the seventh aspect, the display area is divided into subgroups each comprising L lines; column elements selected in an orthogonal matrix of L+D lines composed of +1 and −1 are made corresponding to each line of the subgroups; row voltage levels where +1 corresponds to +VR and −1 corresponds to −VR are applied to each row electrode of the subgroups; an L number of column data elements intersecting a certain row electrode are represented as −1 in an ON display time or +1 in an OFF time and a D number of dummy data are made corresponding to column data elements to prepare an L+D number of column data elements; inner products are obtained from such column data elements and column elements in the orthogonal matrix of L+D lines; predetermined column voltages in proportion to the inner products are applied to the column electrodes in synchronism with the row electrodes, L which satisfies $\sqrt{(M/L\cdot(L+D))}\neq N$ where N represents the maximum value of the inner products is used, and a bias ratio $B_X$ given by VR/VC where VC represents the maximum column voltage satisfies $1\leqq B_X<B_{OPT}$.

According to the ninth aspect of the present invention, in the seventh or eighth aspect, $0.3\sqrt{M}\leqq L+D\leqq 2\sqrt{M}$ and $0.3B_{OPT}\leqq B_X\leqq 0.9B_{OPT}$ are satisfied.

According to the eleventh aspect of the present invention, in the eighth aspect, $B_X=1$ is satisfied.

According to the twelfth aspect of the present invention, in the seventh, eighth, ninth or tenth aspect, $20\leqq M\leqq 80$, L=6 and D=2 are satisfied.

According to the thirteenth aspect of the present invention, in the seventh, eighth, ninth or tenth aspect, $40\leqq M\leqq 100$ and $B_X\leqq 0.7B_{OPT}$ are satisfied.

According to the fourteenth aspect of the present invention, in the first, second, third, fourth, fifth, seventh, eighth, ninth, tenth or eleventh aspect, $24\leqq M\leqq 40$ and $B_X\leqq 0.75B_{OPT}$ are satisfied.

In accordance with the present invention, a multiple line addressing driving is effected with an L number of simultaneously selected row electrodes to provide $L\neq\sqrt{M}$ where M represents the total number of row electrodes for driving a display area and L represents the number of simultaneously selected row electrodes, wherein driving is performed at a driving bias ratio which is deviated toward the minimum bias ratio at which a driving voltage is the minimum at VR/VC=1 with respect to the optimum bias ratio at which an ON/OFF ratio is the maximum. Accordingly, a low driving voltage is obtainable in comparison with the conventional case where driving is effected by MLA system with $L=\sqrt{M}$ while the reduction of picture quality is prevented and a practical ON/OFF ratio can be maintained. Thus, a low voltage driving is performed, which was impossible in the conventional driving system.

Further, in the present invention, since driving is performed with the minimum bias ratio (VR/VC)=1, a part of column voltage levels and a voltage level applied to row electrodes can commonly be used, and the number of voltage levels necessary to drive the liquid crystal can be reduced. With this, the power source voltage circuit to generate voltage levels can be simplified and, cost reduction and low power consumption are obtainable.

In particular, when dummy rows are used, a multiple line addressing driving is effected with an L number of simultaneously selected row electrodes to provide $\sqrt{(M/L\cdot(L+D))}\neq N$ where D represents the number of dummy rows and N represents the maximum magnifying power of a unit column voltage obtained by a predetermined matrix calculation based on display data and scanning voltages applied to the row electrodes. In this case, when the driving is performed at a bias ratio of VR/VC which is deviated toward the minimum bias ratio at which a driving voltage is the minimum with respect to the optimum bias ratio at which the ON/OFF ratio is the maximum, the same effect can be expected. Further, in this case, with use of dummy data, the relation between image data and column voltage can be determined so as not to use a column voltage series including the maximum column voltage. In this case, when selection is repeated on the same simultaneously selected number L, the effect for lowering driving voltage is obtainable in comparison with a case without using dummy rows. Further, from the above-mentioned reason, the number of column voltage levels can be reduced, and accordingly, the power source voltage circuit can be simplified, and reduction of cost and low power consumption can be realized.

Further, since the driving is performed with an L number of simultaneously selected rows which satisfies $0.3\sqrt{M}\leqq L\leqq 2\sqrt{M}$, and at a bias ratio in a range of from 0.3 times to 0.9 times as much as the optimum bias ratio, a predetermined ON/OFF ratio can be assured regardless of the total number of electrodes for the display area, and driving is performed with a low driving voltage which was impossible to realize in the conventional MLA system.

In particular, when the total number of row electrodes for the display area is 20–100, and driving is effected with a simultaneously selected number of 4 at the minimum bias ratio (VR/VC)=1, the number of voltage levels necessary to drive the liquid crystal can be reduced in addition to the effect for lowering voltage; the power source voltage circuit for generating voltage levels is simplified, and reduction of cost and low power consumption are obtainable.

Further, in use of dummy rows, a number of dummy rows satisfying D/(D+L)<0.5 should be used for driving. There tends to decrease the ON/OFF ratio with increasing the number of dummy rows in a case of driving using a same simultaneously selected number and a same bias ratio. However, with such range, there is no possibility of being recognized as reduction of display quality. Further, the lowering of voltage is obtainable.

In particular, when driving is performed with a total number of row electrodes of display area of 20–80, a simultaneously selected number of 6 and a dummy row number of 2, the column voltage level can be reduced in addition to remarkable effect of lowering voltage, whereby the power source voltage circuit can be simplified. Further, reduction of cost and low power consumption are realized.

On the basis of the above-mentioned inventions, when driving is performed under the conditions that the total number of row electrodes for the display area is 40–100, and a bias ratio which is not more than 0.7 times as much as the optimum bias ratio is used for driving, it is sufficient to drive with a power source voltage of 5.5 V or lower. Accordingly, unlike the conventional driving method, it is possible to form a power source with a voltage increased by twice even when a button battery is used for driving, and a special reduction of power consumption is obtainable. Further, since a ratio of the power source voltage to the maximum value of the column voltage and row voltage supplied to the liquid crystal is small, a driving circuit for the liquid crystal device can be formed with a standard logic process.

Further, when driving is performed under the conditions that the number of the total number of row electrodes for the display area is 40–100, and a bias ratio which is not more than 0.6 times as much as the optimum bias ratio is used for driving, it is sufficient to drive with a power source voltage of 5.0 V or lower. Accordingly, a sufficient margin can be assured even when there is a temperature variation. Therefore, a standard logic process can be used to form a driving circuit for the liquid crystal display device so as to obtain a stable operation in addition to the permission of use of a button battery for driving.

Further, when driving is performed under the conditions that the total number of row electrodes for the display area is 24–40 and a bias ratio which is not more than 0.75 times as much as the optimum bias ratio is used for driving, it is sufficient to drive with a driving voltage of 3.3 V or lower. Accordingly, a button battery can be used for directly driving, and the structure of the device can be simplified by, for example, eliminating a voltage increasing circuit.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 4 is a diagram showing that dummy data are added to actual display data in the MLA driving system;

FIG. 6 is a diagram showing a result of simulation for driving the liquid crystal display device according to the third embodiment of the present invention;

FIG. 7 is a diagram showing a voltage lowering effect to an IAPT method in each of the systems;

FIG. 8 is a diagram showing a result of simulation for driving the liquid crystal display device according to the fourth embodiment of the present invention; and FIG. 9 is a diagram showing a voltage lowering effect to the IAPT method in each of the systems.

DESCRIPTION OF THE PREFERRED EMBODIMENTS

Preferred embodiments of the present invention will be described.

Embodiment 1

Figure 1:
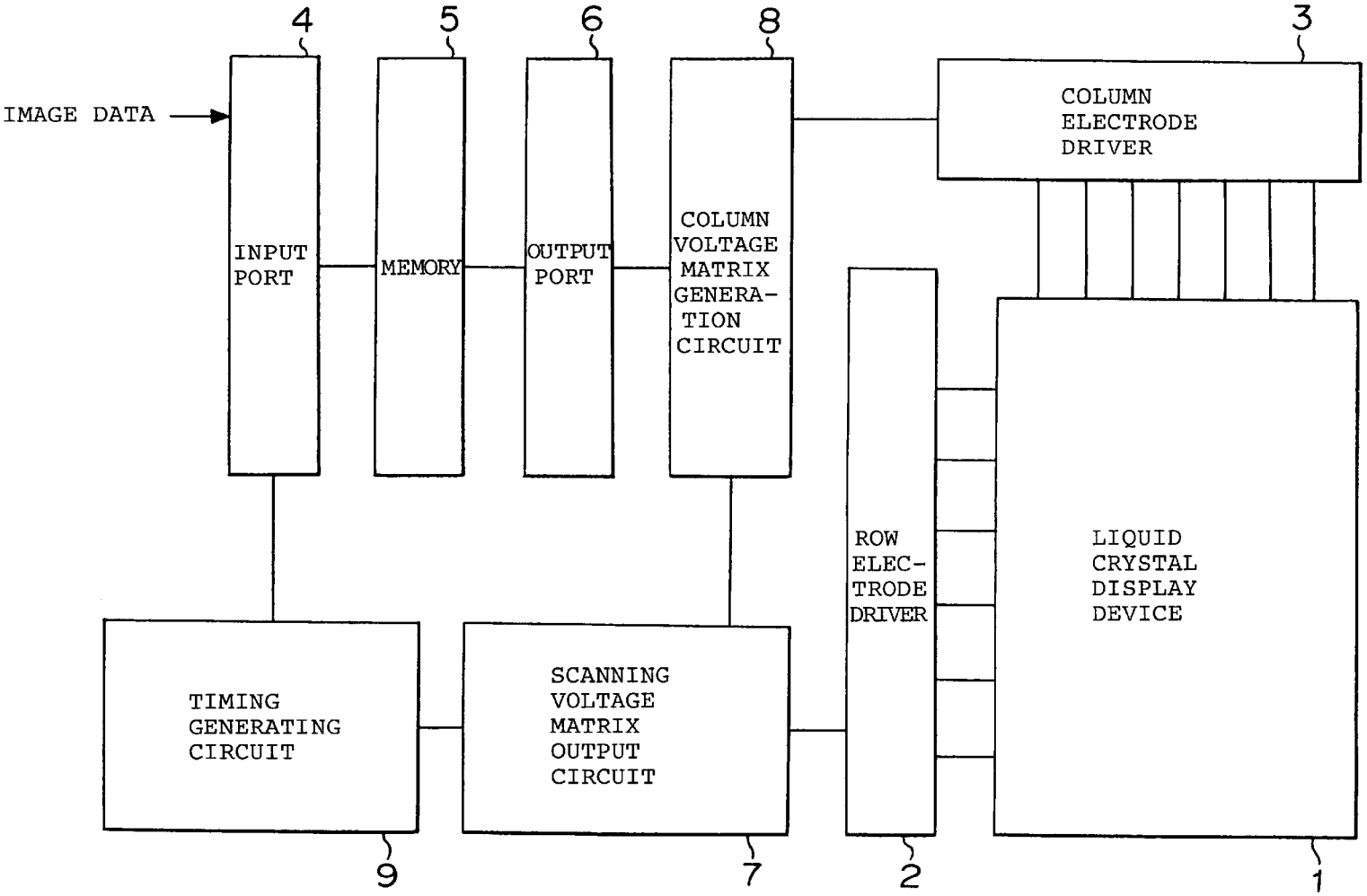
FIG. 1 is a block diagram showing a liquid crystal display device and its peripheral portions according to an embodiment of the present invention.

FIG. 1 is a structural diagram of the liquid crystal display device and its peripheral devices according to Embodiment 1 of the present invention. In FIG. 1, numeral 1 designates a simple matrix liquid crystal display device (a liquid crystal display device) comprising a plurality of liquid crystal display elements arranged in a matrix form, a plurality of row electrodes arranged along a direction of arrangement of the liquid crystal display elements and a plurality of column electrodes arranged along the other direction of arrangement of the liquid crystal display elements wherein a degree of brightness of each liquid crystal display element can be controlled in response to an averaged effective voltage applied across a row electrode and a column electrode during an effective voltage response time of the liquid crystal element; numeral 2 designates a row electrode driver for applying scanning voltages to the plurality of row electrodes for each group consisting of a predetermined L number of simultaneously selected row electrodes; numeral 3 designates a column electrode driver for applying column voltages to the plurality of column electrodes in synchronism with the application of the scanning voltages; numeral 4 designates an input port to which image data to be displayed on each of the liquid crystal elements are successively input; numeral 5 designates a memory for memorizing the image data in a state corresponding to the matrix; numeral 6 designates an output port for reading the image data as an image matrix information for each group of the simultaneously selected row electrodes from the memory; numeral 7 designates a scanning voltage matrix output circuit for outputting a scanning voltage matrix information to be applied to the simultaneously selected row electrodes; numeral 8 designates a column voltage matrix generation circuit for conducting matrix operations based on the scanning voltage matrix information and the image matrix information to output a result as a column voltage matrix information, and numeral 9 designates a timing generation circuit for synchronizing the operation of the other circuits.

The operation will be described.

The image data inputted as serially arranged data into the input port 4 are successively stored in the memory in a state corresponding to the matrix of the liquid crystal elements, and then, they are outputted as image matrix information for each simultaneously selected row electrode group through the output driver. In synchronism with this, a column voltage matrix information is outputted from the scanning voltage matrix output circuit 7 to the row electrode driver 2 and the column electrode matrix generation circuit 8. The column voltage matrix generation circuit 8 performs matrix operations based on the scanning voltage matrix information and the image matrix information to obtain a result, which is outputted as column voltage matrix information to the column electrode driver 3. In synchronism with that the row electrode driver 2 applies to the simultaneously selected row electrode groups scanning voltages in accordance with the scanning voltage matrix, the column electrode driver 3 applies to a plurality of column electrodes column voltages in accordance with the column voltage matrix. The above-mentioned operation is repeated. When the scanning voltages in accordance with the scanning voltage matrix are applied to all the row electrodes, a degree of brightness on each liquid crystal element is controlled in response to an effective voltage applied during a time in which the repetitive operations are finished (hereinbelow, referred to as a frame period) whereby a picture image base on the image data is displayed on the liquid crystal display device 1.

A more concrete example will be described. Formula 1 shows the above-mentioned scanning voltage matrix wherein "+1" corresponds to $+V_R$ and "−1" corresponds to $-V_R$. The matrix as shown is called an Hadamard's matrix of 4 row·4 column (an orthogonal matrix). Formula 2 shows the first image matrix and Formula 3 shows the second image matrix wherein "−1" corresponds to, for example, an ON display, and in this case, "1" corresponds to an OFF display. Formula 4 shows a column voltage matrix in correspondence with the Formula 2 and Formula 5 shows a column voltage matrix in correspondence with the Formula 3. In the Formulas, "0", "2", "4", "−2" and "−4" respectively show a magnifying power of a unit column voltage. To each row electrode, a voltage obtained by multiplying the unit column voltage by any of the multiplying powers is applied provided that in this case, the maximum magnifying power (N) is 4.

The voltages shown in these matrices are applied to a simultaneously selected row electrode group and predetermined column electrodes in a manner that "first, voltages shown in the first column in the scanning voltage matrix are applied, and at the same time, the first row of the column voltage matrix is applied, and then, voltages shown in the second column in the scanning voltage matrix are applied, and at the same time, the second row of the column voltage matrix is applied, . . . ". The above-mentioned operations are repeated to all matrix elements whereby an average effective voltage in response to the image matrix is applied to each of the four liquid crystal elements so that the liquid crystal element is controlled to have a degree of brightness corresponding to the average effective voltage.

The average effective voltage is determined so that an effective response time for the liquid crystal element generally coincides with the above-mentioned one frame period, i.e., average effective voltage per frame period.

$$\begin{pmatrix} 1 & 1 & 1 & -1 \\ 1 & -1 & 1 & 1 \\ 1 & 1 & -1 & 1 \\ 1 & -1 & -1 & -1 \end{pmatrix} \quad \text{(Formula 1)}$$

$$\begin{pmatrix} 1 \\ -1 \\ 1 \\ -1 \end{pmatrix} \quad \text{(Formula 2)}$$

$$\begin{pmatrix} 1 \\ 1 \\ 1 \\ -1 \end{pmatrix} \quad \text{(Formula 3)}$$

$$\begin{pmatrix} 1 & 1 & 1 & -1 \\ 1 & -1 & 1 & 1 \\ 1 & 1 & -1 & 1 \\ 1 & -1 & -1 & -1 \end{pmatrix}^t \begin{pmatrix} 1 \\ -1 \\ 1 \\ -1 \end{pmatrix} \begin{pmatrix} 0 \\ 4 \\ 0 \\ 0 \end{pmatrix} \quad \text{(Formula 4)}$$

$$\begin{pmatrix} 1 & 1 & 1 & -1 \\ 1 & -1 & 1 & 1 \\ 1 & 1 & -1 & 1 \\ 1 & -1 & -1 & -1 \end{pmatrix}^t \begin{pmatrix} 1 \\ 1 \\ 1 \\ -1 \end{pmatrix} \begin{pmatrix} 2 \\ 2 \\ 2 \\ 2 \end{pmatrix} \quad \text{(Formula 5)}$$

In Embodiment 1 having the above-mentioned basic structure, the relation between a supplied voltage required for the column electrode driver and the row electrode driver under the conditions described below and the ratio of an effective voltage in an ON display time to an effective voltage in an OFF display time of the liquid crystal display device (hereinbelow, referred to as an ON/OFF ratio), was examined. The conditions were such that the number L of simultaneously selected row electrodes was 4 and the total number M of row electrodes set in the column voltage matrix generation circuit was 32. Further, the liquid crystal display device included STN liquid crystal elements having a twist angle of 240°, a refractive index anisotropy of 0.145 and a dielectric anisotropy of +24.7, which were arranged in a dot matrix form of 32 rows×240 columns. In the liquid crystal display device, an effective voltage necessary for driving simultaneously all the row electrodes to provide an ON display was 1.2 V.

Figure 2:
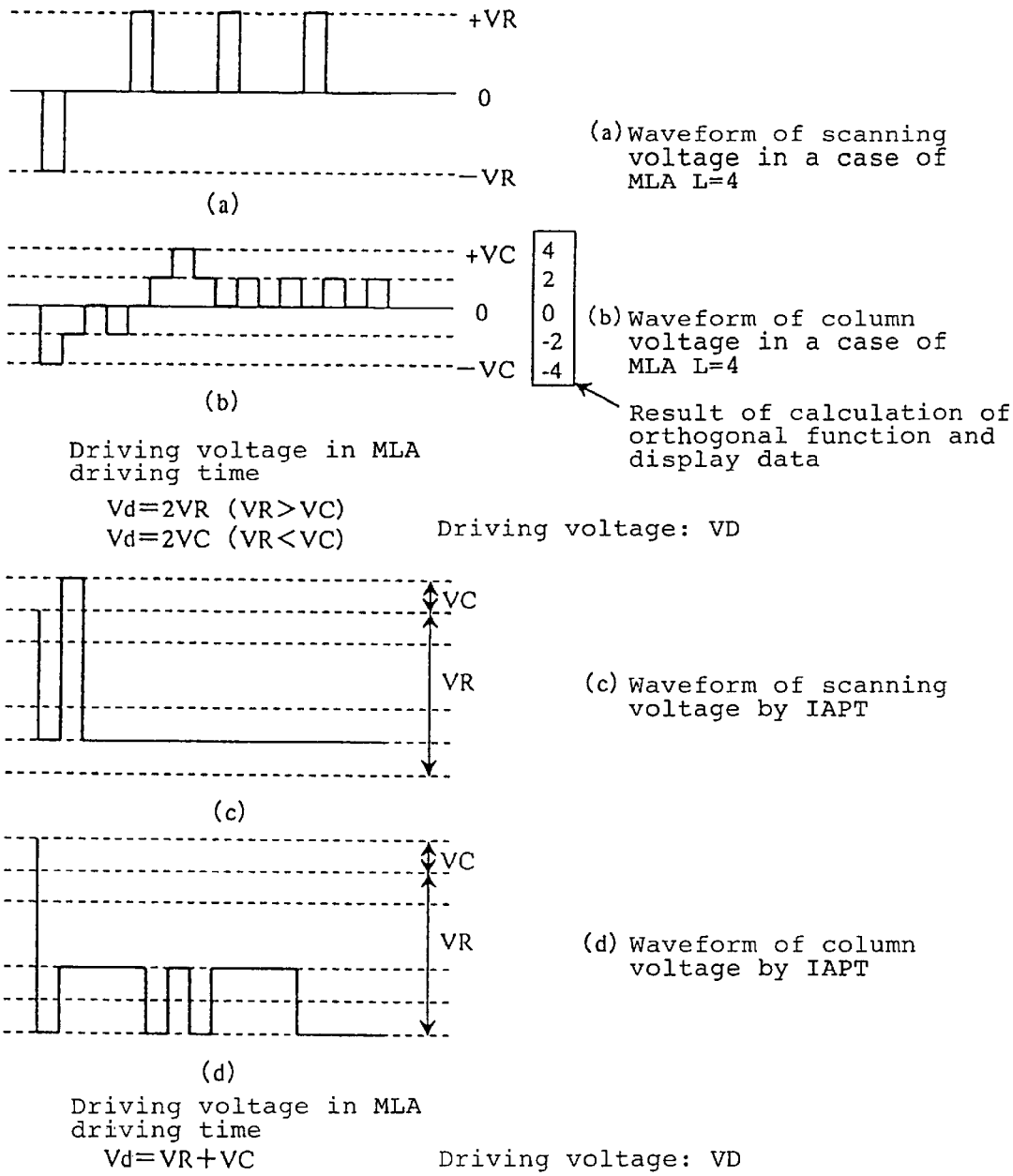
FIG. 2 is a diagram showing a MLA voltage waveform and an IAPT voltage waveform.

Concrete waveforms applied in the MAL method are shown in FIGS. 2(*a*) and 2(*b*). The voltage waveform of row electrode in FIG. 2(*a*) has +VR corresponding to +1 and −VR corresponding to −1 according to the elements of an orthogonal matrix, and a voltage amplitude of 2 VR having zero as the center. The voltage waveform of column electrode in FIG. 2(*b*) has an applied voltage in proportion to an inner product of an element of the orthogonal matrix and a display element. In the MLA driving method (where L=4) in the figure, when a voltage corresponding to 4 as the maximum value as a result of calculation is represented by +VC, the column voltage has a voltage amplitude of 2 VC having zero as the center. From the above, a power source voltage required to drive the liquid crystal (or a driving voltage) should have a power source amplitude of 2 VR or 2 VC whichever larger.

Concrete waveforms applied for a line successive driving (hereinbelow, referred to as an IAPT driving method) are shown in FIGS. 2(*c*) and 2(*d*). In order to drive the liquid crystal, a power source voltage having an voltage amplitude of VR+VC which is necessary for the IAPT method is required.

Figure 3:
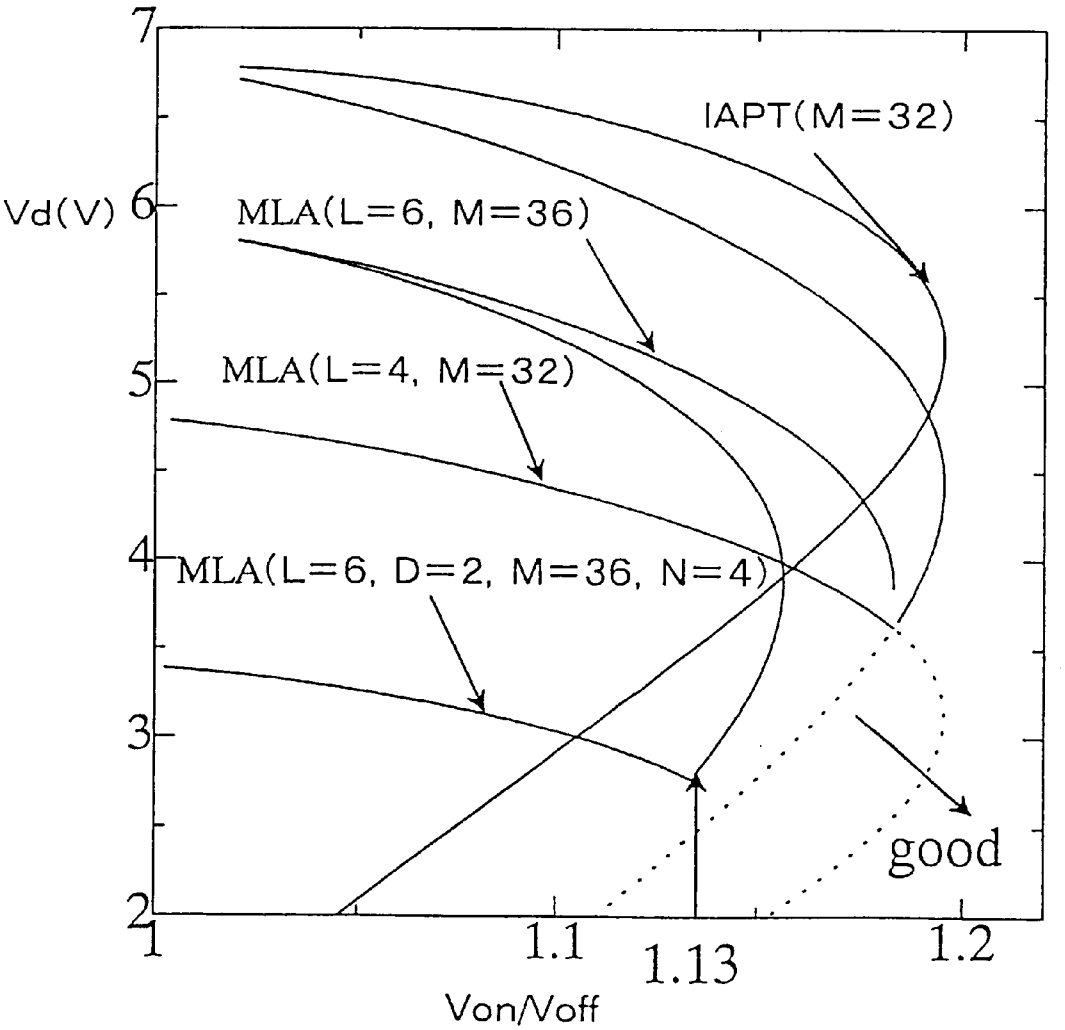
FIG. 3 is a diagram showing a relation of a driving voltage to an ON/OFF ration in various driving systems.

FIG. 3 is a diagram showing the relations between a ratio of an effective voltage in an ON display time to an effective voltage in an OFF display time and a driving voltage in several driving systems wherein the ratio of a row voltage VR to the maximum column voltage VC (hereinbelow, referred to as a driving bias ratio=VR/VC) is gradually changed. In the figure, MLA (L=4, M=32) indicates a curve obtained in Embodiment 1; MLA (L=6, D=2, M=36, N=4) indicates a curve obtained in Embodiment 2; IAPT (M=32) indicates a curve obtained in Comparative Embodiment 1; and MLA (L=6, M=36) indicates a curve obtained in Comparative Embodiment 2.

As is clear from this relational figure, the curve corresponding to Embodiment 1 of the present invention extends in a lower right region in comparison with the curves of Comparative Embodiments 1 and 2, from which it is understood that it has the same ON/OFF ratio as Comparative Embodiments 1 and 2, and it is possible to drive the liquid crystal elements with a lower driving voltage than that of these Comparative Embodiments. In particular, it is possible, on one hand, to drive the device with a lower driving voltage at a driving bias ratio which is higher than VR/VC=1 at which the driving voltage is the minimum and which is lower than the optimum bias ratio, and, on the other hand, to provide a high ON/OFF ratio in comparison with a bias ratio which is lower than the minimum bias ratio VR/VC=1, whereby the same display as the conventional MLA driving system can be obtained. Further, when driving is performed at the minimum bias ratio VR/VC=1, a part of the column voltage levels and voltage levels to be applied to row electrodes can commonly be used, and the voltage level necessary to drive the liquid crystal can be decreased. With such measures, the power source voltage circuit for generating a voltage level is simplified, and cost reduction and low power consumption can be realized.

Embodiment 2

A liquid crystal display device wherein the number L of simultaneously selected row electrodes was 6; the total number M of row electrodes set by the column voltage matrix generation circuit was 36; and two dummy rows D, which did not exist in the display area, were provided for each of the simultaneously selected groups, was prepared. Then, data on the column voltage matrix were adjusted so that the maximum magnifying power N of the column voltages was at most 4.

This will be described with reference to FIG. 4. The total number of row electrodes 36 are divided into subgroups each comprising 6 rows, and an Hadamard's matrix of 8 rows and 8 columns as an orthogonal matrix is prepared. On each subgroup, all the column vectors in the Hadamard's matrix are once applied. On the row electrodes, 6 lines in the 8 row orthogonal matrix are applied to the actual electrodes according to polarities. On the column electrodes, column vectors in the orthogonal matrix and voltages in response to inner products of display data are applied. A result of calculation of 6 actual data is shown in FIG. 4(*a*). When 2 dummy data are determined appropriately in addition to the 6 actual data, a result of calculation is shown in FIG. 4(*b*). In the result of calculation on the 6 actual data, 7 voltage levels: 6, 4, 2, 0, −2, −4, and −6, are required in response to the display data. However, when calculation is conducted with 2 dummy data in addition to the 6 actual data, only 3 voltage levels: 4, 0 and −4, are required. Further, even when the 6 actual data are changed, a result of calculation can be given with 3 values: 4, 0 and −4, by changing the dummy data in response to the actual data. As described above, it is possible to reduce the number of necessary column voltage levels by using dummy data in response to actual data, in comparison with a case without using dummy data. Namely, the sole use of this method implies that the power source voltage circuit for generating voltage levels can be simplified, and cost reduction and low power consumption can be realized.

4 Rows among 36 rows are not actually applied to the liquid crystal display device.

The structure other than the above-mentioned is the same as that of Embodiment 1 and description is therefor omitted.

A result obtained by the operation is shown in FIG. 3. As is clear from the figure, in the curve corresponding to Embodiment 2, the minimum bias ratio is produced by a further lower driving voltage (2.79 V) in comparison with the case of Embodiment 1, and the ON/OFF ratio at that time is 1.132. Accordingly, it is possible to provide the same function as Embodiment 1 and a practically usable ON/OFF ratio while driving can be performed with a further lower driving voltage than that in Embodiment 1.

Comparative Embodiment 1

The construction of the liquid crystal display device is the same as that of Embodiment 1 except that it is adapted to be driven by IAPT driving system, and therefore, description is omitted.

A result obtained is shown in FIG. 3. As is clear from the figure, in Comparative Embodiment 1, the driving voltage Vd tends to decrease in a region where the ON/OFF ratio is the maximum toward a region having a lower ON/OFF ratio. However, it is smaller than the optimum bias ratio of Embodiment 1, and the driving voltage Vd of Comparative Embodiment is always not lower than the driving voltage of Embodiment 1 in a region of ON/OFF ratio assuming the minimum bias ratio. Similarly, the driving voltage Vd of Comparative Embodiment 1 is always not lower than that of Embodiment 1 in a region of ON/OFF ratio assuming the minimum bias ratio and smaller than the optimum bias ratio of Embodiment 2.

Comparative Embodiment 2

A liquid crystal display device wherein the number L of simultaneously selected row electrodes was 6; the total number M of row electrodes set by the column voltage matrix generation circuit was 36, and a scanning voltage matrix of 6 row·8 column was set, was prepared. 4 Rows among 36 rows were not actually applied to the liquid crystal display device. Other elements are the same as those of Embodiment 1, and description is omitted.

A result is shown in FIG. 3. As is clear from the figure, Comparative Embodiment 2 did not show a driving voltage which was lower than the optimum bias ratio at which the ratio of an effective voltage in an ON display time to an effective voltage in an OFF display time was the maximum. Further, the point providing such ON/OFF ratio is in an upper left region with respect to the curve of Embodiment 1, and does not show a lower driving voltage at the same ON/OFF ratio. Further, the driving voltage Vd of Comparative Embodiment 1 is always not lower in a region of ON/OFF ratio assuming the minimum bias ratio and smaller than the optimum bias ratio of Embodiment 2.

Figure 5:
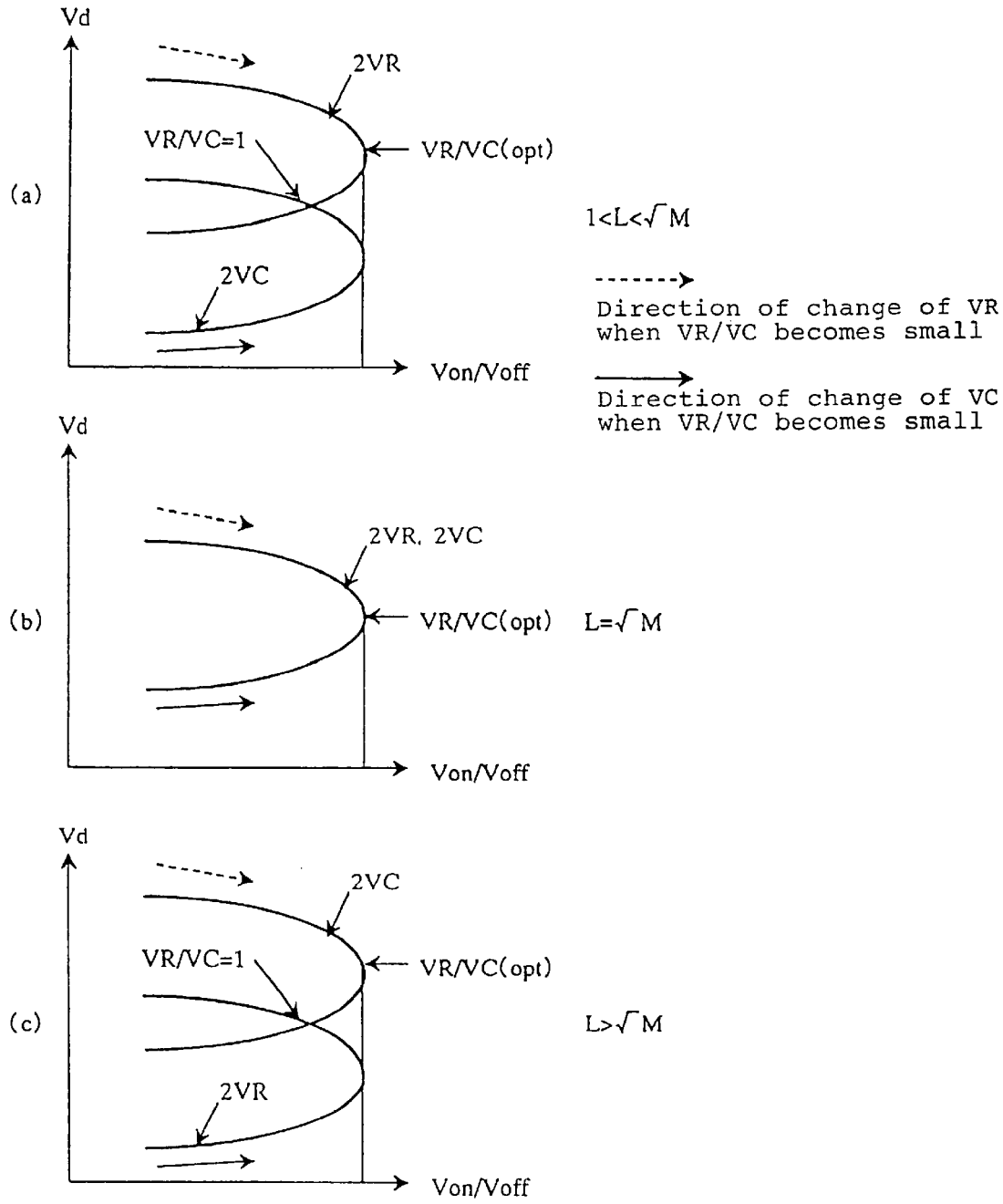
FIG. 5 is a diagram showing curves of scanning voltage and column voltage when a relation of a total number of row electrodes and a simultaneously selected number is changed in the MLA system.

FIG. 5 shows the relations between an ON/OFF ratio and a driving voltage wherein the relation between the number L of the simultaneously selected rows and the number M of the total row electrodes is changed. FIG. 5*a* shows relationships in a case of $1<L<\sqrt{M}$; FIG. 5*b* shows relationship in a case of $L=\sqrt{M}$ and FIG. 5*c* shows relationship in a case of $\sqrt{M}<L$ wherein VC represents a curve indicating the maximum column voltage (=unit column voltage×magnifying power N×2) and 2 VR is a curve indicating a scanning voltage. The curve of Embodiment 1 and the curve of Embodiment 2 as shown in FIG. 2 are respectively obtained in the same manner as obtaining by selecting either the curve indicating the maximum column voltage or the curve indicating the scanning voltage, shown in FIG. 5*c,* whichever is greater in voltage. The curve of Comparative Embodiment 2 shown in FIG. 3 can be obtained in the same manner as obtaining by selecting either the curve indicating the maximum column voltage or the column indicating the scanning voltage, shown in FIG. 5*b,* whichever is greater in voltage.

Embodiment 3

A liquid crystal display device comprising STN liquid crystal elements having a twist angle of 240°, a refractive index anisotropy of 0.145 and a dielectric anisotropy of +24.7, which are arranged in a dot matrix form of 32 rows and 240 columns was used to confirm its operation. An effective voltage obtained when all the row electrodes were simultaneously driven to provide an ON display was 1.2 V.

With use of the liquid crystal display device, simulation on the ON/OFF ratio and the driving voltage was conducted. FIGS. 6 and 7 shows a part a result obtained. For comparison, FIG. 6 shows a result in a case that the liquid crystal display device is driven by IAPT driving system as well as a result in a case that the device is driven by the conventional MLA driving system.

In order to clearly show respective effects of FIG. 6, the voltage lowering effect to the driving voltage in the IAPT method by using the same ON/OFF ratio (a ratio of effective voltages in ON and OFF display times) is shown in FIG. 7.

As a result, it has been confirmed that when the liquid crystal display device is driven with an L number of simultaneously selected rows satisfying $0.3\sqrt{M}\leqq L\leqq 2\sqrt{M}$ where no dummy is used or an L number of simultaneously selected rows satisfying $0.3\sqrt{M}\leqq L+D\leqq 2\sqrt{M}$ where a dummy or dummies are used, and when it is driven at the minimum bias ratio of VR/VC (VR/VC=1), a predetermined ON/OFF ratio can be assured regardless of the total number of row electrodes for the display area, and the device can be driven with a lower driving voltage than that of the conventional multiple line driving system or IAPT driving system.

Further, it has also been confirmed that when the total number M of row electrodes used is 24–40 and a bias ratio of 0.75 times or lower than the optimum bias ratio is used for driving, a driving voltage of 3.3 V or lower is sufficient for driving. Under these conditions, accordingly, it is possible to drive directly with use of a button battery. The structure of the device can be simplified by omitting a voltage increase circuit, and a driver circuit for a liquid crystal display device can be formed by using a standard logic process.

It has also been confirmed that when a dummy (dummies) is used, in this case, a number of dummies satisfying $D/(D+L)<0.5$ is used and if driving is effected at the same driving bias ratio on the same number L of simultaneously selected rows, the ON/OFF ratio tends to decrease as the number of dummy rows is increased. However, it was confirmed that with such range, there was no danger of being recognized as reduction in the display quality, and the power source voltage could be reduced without causing deterioration of the picture quality.

Embodiment 4

A liquid crystal display device comprising STN liquid crystal elements having a twist angle of 240°, a refractive index anisotropy of 0.144 and a dielectric anisotropy of +13.6, which were arranged in a dot matrix form of 64 rows and 240 columns, was prepared to confirm its operation. An effective voltage obtained when all the row electrodes were simultaneously driven to provide an ON display, was 1.55 V.

With such liquid crystal display device, simulation was conducted on the ON/OFF ratio and the driving voltage.

FIGS. 8 and 9 show a part of a result by the simulation. For comparison, FIG. 8 shows, in parallel, a result obtained by driving the liquid crystal display device by the conventional MLA driving system.

In order to clearly show respective effects of FIG. 8, the voltage lowering effect to the driving voltage on the IAPT driving method by using the same ON/OFF ratio is shown in FIG. 9.

As a result, it has been confirmed that when the device is driven with an L number of simultaneously selected rows satisfying $0.3\sqrt{M} \leqq L \leqq 2\sqrt{M}$ in a case of using no dummy, or when the device is driven with an L number of simultaneously selected rows satisfying $0.3\sqrt{M} \leqq L+D \leqq 2\sqrt{M}$ in a case of using a dummy (dummies) wherein driving is performed at the minimum bias ratio of VR/VC (VR/VC=1), driving can be achieved with a lower driving voltage than that in the conventional MLA driving system or IAPT driving system while a predetermined ON/OFF ratio can be assured irrespective of the total number of row electrodes for the display area.

In particular, it has been confirmed that when the total number of row electrodes for the display area is 40 to 100 and a bias ratio used for driving is at most 0.7 times as much as the optimum bias ratio, a power source voltage of at most 5.5 V is sufficient to drive the liquid crystal display device. Also, it has been confirmed that the power source voltage is increased by twice to thereby lower remarkably power and a driver circuit for the liquid crystal display device can be formed by using a standard logic process.

Further, it has been confirmed that when the total number of row electrodes for the display area is 40 to 100 and driving is performed at a bias ratio of at most 0.6 times as much as the optimum bias ratio, a power source voltage of at most 5.0 V is sufficient. Also, it has been confirmed that use of a button battery or the like is allowed for driving and a driver circuit for the liquid crystal display device can be formed by using a standard logic process to obtain a stable operation since a sufficient margin can be maintained even in a case of temperature variation.

When a dummy (dummies) is used and if driving is performed with a number of dummies satisfying $D/(D+L) < 0.5$ at the same driving bias ratio on the same number L of simultaneously selected rows, the ON/OFF ratio tends to decrease as the number of dummy rows is increased. However, it has been confirmed that with such range, there is no danger of being recognized as reduction in the display quality while the power source voltage can be reduced without causing deterioration of the picture quality.

What is claimed is:

1. A method for driving a simple matrix liquid crystal display device characterized by conducting a multiple line driving with an L number of simultaneously selected row electrodes to provide $L \neq \sqrt{M}$ where M represents the total number of row electrodes for driving a display area and L represents the number of simultaneously selected row electrodes, wherein driving is performed at a bias ratio which is deviated toward the minimum bias ratio at which a driving voltage is the minimum with respect to the optimum bias ratio $B_{OPT}$ at which a ratio of an effective voltage value in an ON display time to an effective voltage value in an OFF display time is the maximum.

2. The method for driving a simple matrix liquid crystal display device according to claim 1, wherein the display area is divided into subgroups each comprising L lines; column elements selected in an orthogonal matrix of L lines composed of +1 and −1 are made corresponding to each line of the subgroups; row voltage levels where +1 corresponds to +VR and −1 corresponds to −VR are applied to each row electrode of the subgroups; inner products are obtained from an L number of column data elements, having a value −1 in an ON display time or +1 in an OFF time, which intersect a certain row electrode and column elements in the orthogonal matrix of L lines; predetermined column voltages in proportion to the inner products are applied to column electrodes in synchronism with the row electrodes, a bias ratio $B_X$ given by VR/VC where VC represents the maximum column voltage satisfies $1 \leqq B_X \leqq B_{OPT}$.

3. The method for driving a simple matrix liquid crystal display device according to claim 1, wherein $0.3\sqrt{M} \leqq L \leqq 2\sqrt{M}$ and $0.3B_{OPT} \leqq B_X \leqq 0.9B_{OPT}$ are satisfied.

4. The method for driving a simple matrix liquid crystal display device according to claim 1, wherein $40 \leqq M \leqq 100$ and $B_X \leqq 0.7B_{OPT}$ are satisfied.

5. The method for driving a simple matrix liquid crystal display device according to claim 1, wherein $B_X=1$ is satisfied.

6. The method for driving a simple matrix liquid crystal display device according to claim 1, wherein $20 \leqq M \leqq 40$ and L=4 are satisfied.

7. A method for driving a simple matrix liquid crystal display device characterized by conducting a multiple line addressing system with an L number of simultaneously selected row electrodes to provide $\sqrt{(M/L \cdot (L+D))} \neq N$ where M represents the total number of row electrodes for driving a display area, L represents the number of simultaneously selected row electrodes, D represents a number of dummy row electrodes and N represents the maximum magnifying power of a unit column voltage obtained by a predetermined matrix calculation to display data and scanning voltages applied to the row electrodes, wherein driving is performed at a driving bias ratio which is deviated toward the minimum bias ratio at which a driving voltage is the minimum with respect to the optimum bias ratio $B_{OPT}$ at which a ratio of an effective voltage value in an ON display time to an effective voltage value in an OFF display time is the maximum.

8. The method for driving a simple matrix liquid crystal display device according to claim 7, wherein the display area is divided into subgroups each comprising L lines; column elements selected in an orthogonal matrix of L+D lines composed of +1 and −1 are made corresponding to each line of the subgroups; row voltage levels where +1 corresponds to +VR and −1 corresponds to −VR are applied to each row electrode of the subgroups; an L number of column data elements intersecting a certain row electrode are represented as −1 in an ON display time or +1 in an OFF time and a D number of dummy data are made corresponding to column data elements to prepare an L+D number of column data elements; inner products are obtained from such column data elements and column elements in the orthogonal matrix of L+D lines; predetermined column voltages in proportion to the inner products are applied to column electrodes in synchronism with the row electrodes; L which satisfies $\sqrt{(M/L \cdot (L+D))} \neq N$ where N represents the maximum magnifying power of a unit column voltage obtained by a predetermined matrix calculation to display data and scanning voltages applied to the row electrodes, a maximum value of the inner products, and a bias ratio $B_X$ given by VR/VC where VC represents the maximum column voltage satisfies $1 \leqq B_X < B_{OPT}$.

9. The method for driving a simple matrix liquid crystal display device according to claim 7, wherein $0.3\sqrt{M} \leqq L+D \leqq 2\sqrt{M}$ and $0.3B_{OPT} \leqq B_X \leqq 0.9B_{OPT}$ are satisfied.

10. The method for driving a simple matrix liquid crystal display device according to claim 7, wherein $D/(D+L)<0.5$ is satisfied.

11. The method for driving a simple matrix liquid crystal display device according to claim 8, wherein $B_X=1$ is satisfied.

12. The method for driving a simple matrix liquid crystal display device according to claim 7, wherein $20 \leqq M \leqq 80$, $L=6$ and $D=2$ are satisfied.

13. The method for driving a simple matrix liquid crystal display device according to claim 7, wherein $40 \leqq M \leqq 100$ and $B_X \leqq 0.7B_{OPT}$ are satisfied.

14. The method for driving a simple matrix liquid crystal display device according to claim 1, 2, 3, 4, 5, 6, 7, 8, 9, 10, or 11, wherein $24 \leqq M \leqq 40$ and $B_X \leqq 0.75B_{OPT}$ are satisfied.

* * * * *